US006389140B1

(12) United States Patent
Wei

(10) Patent No.: US 6,389,140 B1
(45) Date of Patent: May 14, 2002

(54) CERAMIC PIEZOELECTRIC TYPE MICROPHONE

(76) Inventor: Jose Wei, 2F, No. 495, Chung-Cheng Road, Hsin Tien City Taipei (TW)

( * ) Notice: Subject to any disclaimer, the term of this patent is extended or adjusted under 35 U.S.C. 154(b) by 0 days.

(21) Appl. No.: 09/450,432

(22) Filed: Nov. 30, 1999

(51) Int. Cl.[7] ..... H04R 25/00

(52) U.S. Cl. ..... 381/173; 381/151; 381/326; 381/368

(58) Field of Search ..... 381/173, 174, 381/114, 151, 190, 326, FOR 130; 310/324

(56) References Cited

U.S. PATENT DOCUMENTS 3,439,128 A * 4/1969 Sobel et al. ..... 381/173
4,012,604 A * 3/1977 Speidel ..... 381/151
5,778,079 A * 7/1998 Wun ..... 381/173

* cited by examiner

*Primary Examiner*—Huyen Le
(74) *Attorney, Agent, or Firm*—Bacon & Thomas, PLLC

(57) ABSTRACT

A ceramic piezoelectric type microphone includes a lower cover and an upper cover, and a receiving space confined by the lower and upper covers when they are connected. A signal wire is led in the receiving space via an extension portion of the lower cover and passes through a substrate to connect to an electrical circuit board. The other side of the circuit board is connected to a piezoelectric ceramic plate. A high-density foam body is sandwiched between the piezoelectric ceramic plate and a securing portion on an inner side of the upper cover. When a ratio value of a diameter of the surface of the upper cover to a contact thickness formed by the upper cover is greater than 0.15, sound waves generated as a result of contact between cover surfaces and the user's throat skill pass through the foam body to the piezoelectric ceramic plate to be directly converted into a signal output, thereby eliminating most of the background noise except the sound of the user's voice.

3 Claims, 4 Drawing Sheets

CERAMIC PIEZOELECTRIC TYPE MICROPHONE

BACKGROUND OF THE INVENTION (a) Field of the Invention:

The present invention relates to a ceramic piezoelectric type microphone, more particularly to a microphone structure that provides precision transmission of sounds of the throat.

(b) Description of the Prior Art:

There is known in the prior art a type of skin contact piezoelectric type microphone. The structure thereof is shown in FIG. 4, As shown the known microphone includes a front cover 61 and a rear cover 62. The front cover 61 has a front edge that is relatively thin, and an inner side provided with bosses 63. After assembly of the front and rear covers 61, 62, an enclosed space 64 is confined therebetween. The rear cover 62 has an end edge forming a stop end 65 for receiving a metallic electrically conductive plate 66. An upper portion of the conductive plate 66 is a PC board 67. The PC board 67 may serve as electrode connecting solder points or include an amplification element circuit. A lower portion of the conductive plate 66 is closely adjacent to an upper piezoelectric ceramic plate 68 and a lower piezoelectric ceramic plate 69. A signal metallic electrically conductive plate 71 is provided below the upper piezoelectric ceramic plate 68. A spring 72 (a reed being shown in FIG. 4) has a larger end disposed in the boss 63 at the front edge of the front cover 21, with the smaller end slightly abutting against the signal metallic electrically conductive plate 71. The conductive plate 66 is provided with a negative signal electrode solder point 73 which is led to a negative signal electrode contact 75 on the PC board 67. The signal metallic electrically conductive plate 71 is provided with a positive signal electrode solder point 74 lead to a positive signal electrode contact 76 on the PC board 67. The positive and negative signal electrode solder points of the PC board 67 are connected by soldering to a signal feeding line 77. The front edge of the front cover 61 is caused to generate a sound wave signal with the signal metallic electrically conductive plate 71. the lower piezoelectric ceramic plate 69. and a ceramic element of the upper piezoelectric ceramic plate 67. The PC board 67 connects to the signal feeding line 77 to feed the signal to an amplification machine to be used. As a relatively large output of sound wave signals can be generated to block the background noise, feedback can be effectively avoided. The tow ceramic piezoelectric elements and the metallic electrically conductive plates can be decreased by one or increased by more than one. The decrease or increase in the number of units will slightly change the output unit voltage and sound quality, but it will not affect the basic characteristics.

However, there are drawbacks with the above-described prior art. In actual use, metallic noise will be generated. Besides, in terms of the wholeness of the high and lows sound ranges and the fidelity of the signals, the above-described prior art is unable to achieve the same level as ordinary microphones. Improvements are there fore necessary.

SUMMARY OF THE INVENTION

A primary object or the present invention is to provide a ceramic piezoelectric type microphone that utilizes a high-density foam material to collect and transmit sound. The vibration of air in the foam material can considerably improve the sound distortion resulting from incomplete high-frequency resonance with conventional piezoelectric type sound collectors. In this way, the output signal of the piezoelectric type microphone is much closer to the original sound. This is because the size of the air cells in the high-density foam material determines the corresponding resonance frequency. If the capacity of the air cells in the foam material is controlled to correspond to the calculation of the sound transmission distance, the fidelity of the transmission of sound can be controlled. For instance, the communication pipe on a military vessel utilizes air to transmit sound. Due to the configuration of the hollow cavity and size of the pipe, whispering words at one end can be transmitted to tells or even hundreds of meters away. In addition, the design of a silent studio necessary for testing stereos is also based on the same principle. However, the object of the silent studio is to absorb all the reflections of sounds. The improvement provided by the present invention is intended to collect and to re-compose and intensity the high and lows sounds, and the completeness of regional sound equality.

According to the present invention, a ceramic piezoelectric type microphone includes a lower cover and an upper cover, and a receiving space confined by the lower and upper covers when they are connected. A signal wire is led in the receiving space via an extension portion of the lower cover and passes through a substrate to connect to an electrical circuit board. The other side of the circuit board is connected to a piezoelectric ceramic plate. A high-density foam body is sandwiched between the piezoelectric ceramic plate and a securing portion on an inner side of the upper cover. When a ratio value of a diameter of the surface of the upper cover to a contact thickness formed by the upper cover is greater than 0.15, sound waves generated as a result of contact between cover surfaces and the user's throat skin pass through the foam body to the piezoelectric ceramic plate to be directly converted into a signal output, thereby eliminating most of the background noise except the sound of the user's voice.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
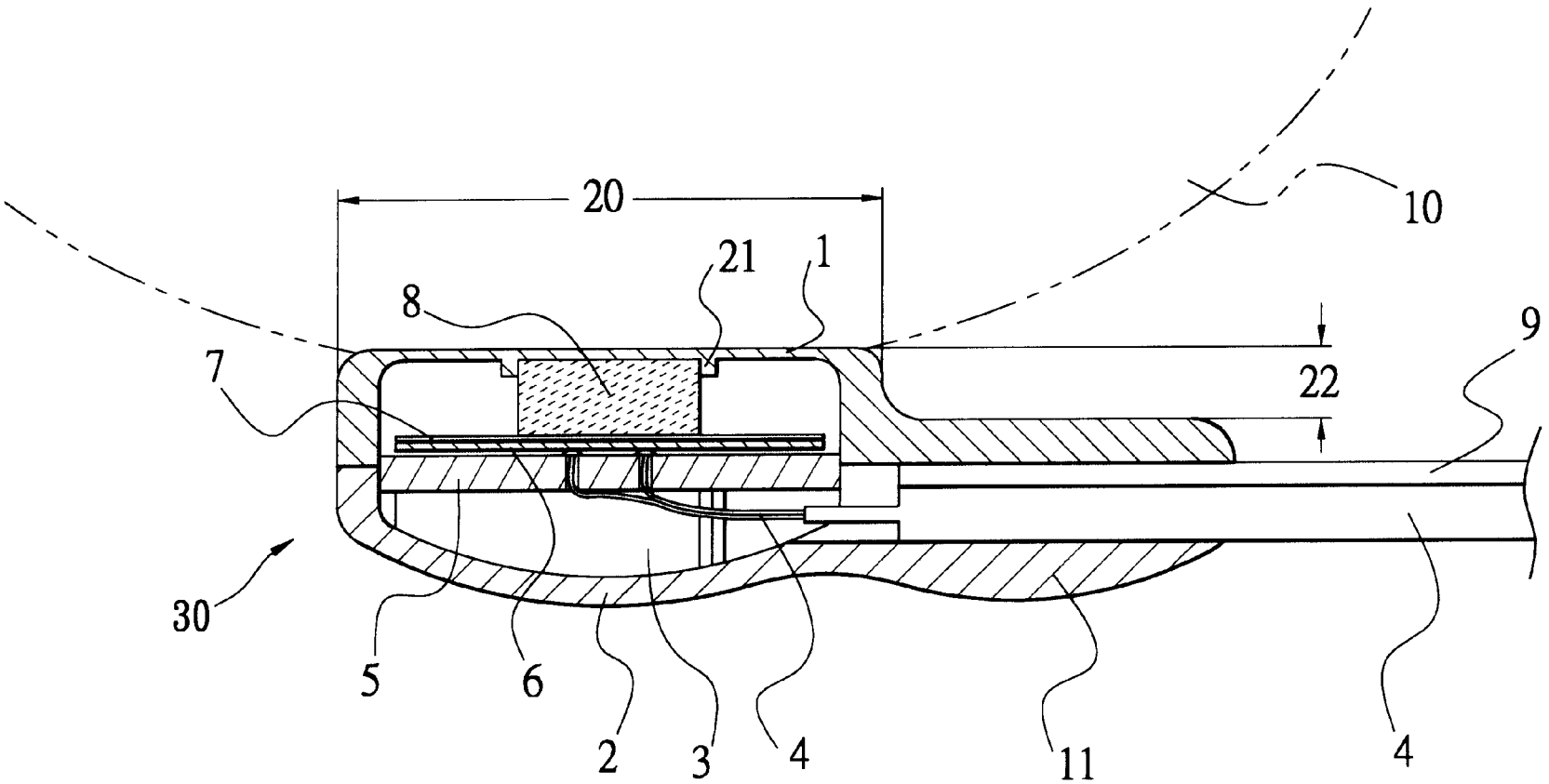
FIG. 1 is a sectional views of the present invention.
Figure 2:
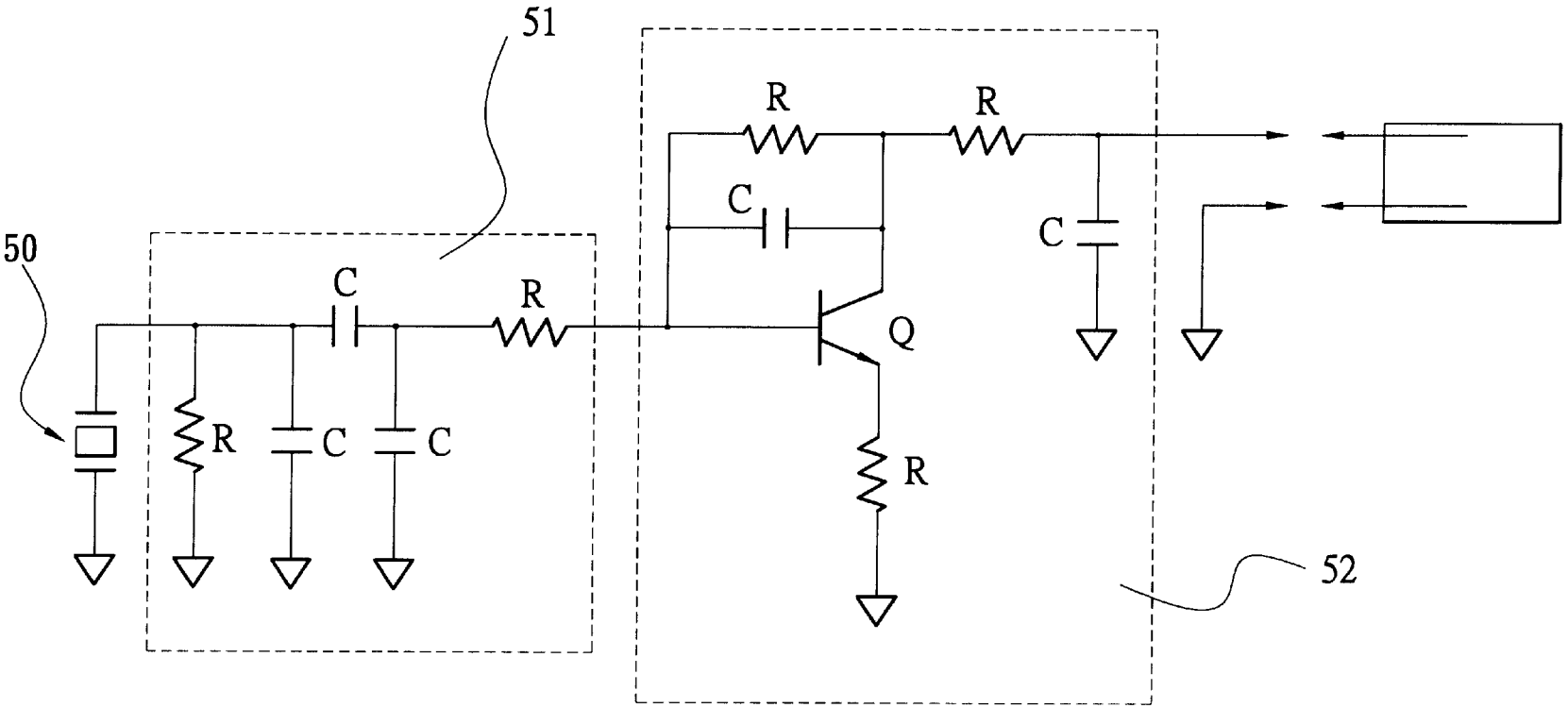
FIG. 2 is a circuit diagram of the present invention.
Figure 3:
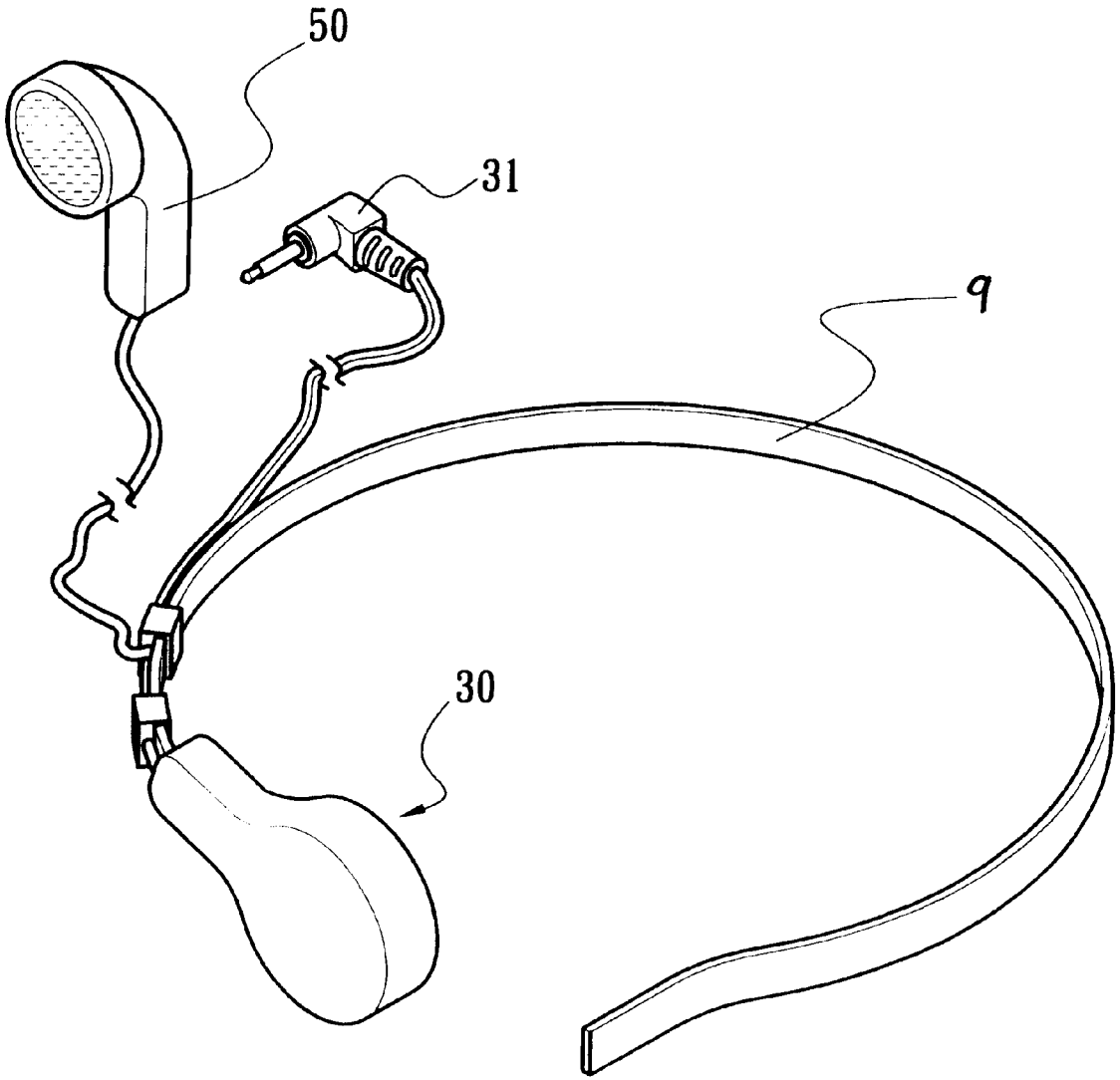
FIG. 3 is a perspective view of the present invention in use.
Figure 4:
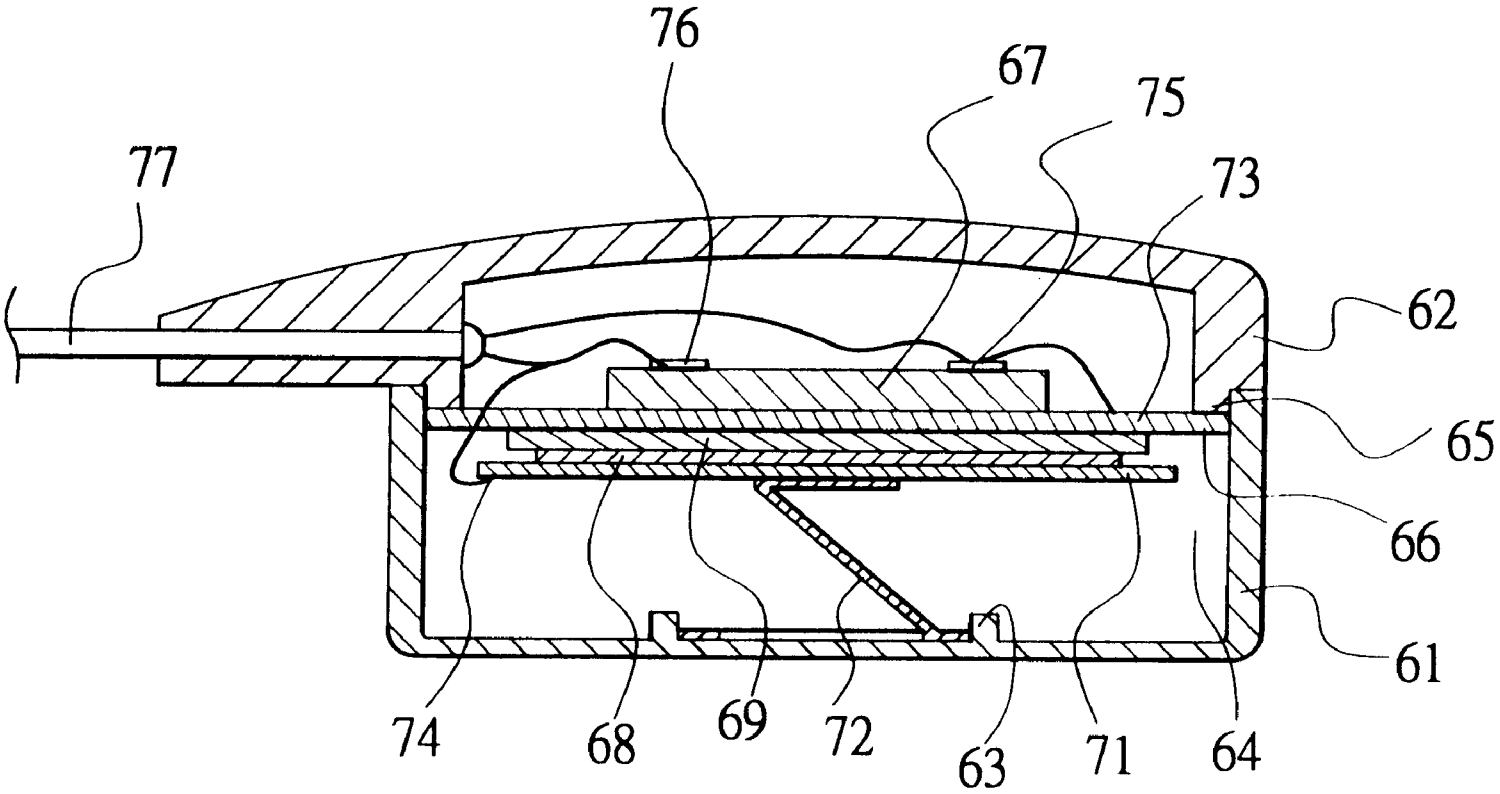
(PRIOR ART) FIG. 4
FIG. 4 is a sectional views of the prior art.

With reference to FIGS. 1 to 3, a ceramic piezoelectric type microphone of the present invention includes lower and upper covers 1, 2, and a receiving space 3 confined by the lower and upper covers 1, 2 after they are placed in position. A signal wire 4 is led in the receiving space 3 via an extension portion 11 of the lower cover 1 passing through a substrate 5 to connect to an electrical circuit board 6. Between the two covers next to the signal wire 4, one end of a fastening ring 9 is connected. The other side of the circuit board 6 is connected to a piezoelectric ceramic plate 7. A high-density foam body 8 is sandwiched between the piezoelectric ceramic plate 7 and a securing portion 21 on an inner side 2 of the upper cover 2. When a contact thickness 22 formed by the diameter 20 of the surface of the upper cover 2 and the upper cover has a ratio value greater than 0.15, the sound waves generated via contact between the upper cover 2 and the user's throat 10 pass through the foam body 8 to the piezoelectric ceramic plate 7 to be directly converted by the circuit board 6 into a signal output from which, except the voice of the user, a large portion of the background noise is attenuated or eliminated.

In summary, the present invention essentially uses high-density foam body to achieve a soft transmission means. The present invention employs the vibration of air in the foam body to generate better sound wave transmission to reduce loss of sound wave strength so as to better preserve the original sound quality. In addition, with reference to FIG. 3, which shows a preferred embodiment of a microphone 30 of the present invention along with a fastening ring 4 and an earphone 31, the present invention can be adapted for use in mobile phones or other electronic devices. Referring to FIG. 2 showing the circuitry of the present invention a sound wave 50 is converted by the induced piezoelectric ceramic plate 7 into an electronic signal, which passes through a resistance matching and waveform processing circuit 5 and then a sound frequency amplifying circuit 52 to generate a power input and a sound frequency output. Hence, the most outstanding feature of the sound after being processed by the induced conversion device is that it not only has all the functions of a microphone but also considerably reduces the background noise without generating much feedback. The ratio value mentioned above is set to serve as reference for achieving optimal use since a user with a relatively thin neck may generate broken sounds due to incomplete contact surfaces or a user with a relatively thick neck will cause the sound resonance generated by the covers to be incomplete. Therefore, it is necessary to have a suitable setting to achieve an optimal use state. Besides, the ratio value is the ratio result of a preferred sound collecting area to a sound transmission distance after calculation. The high-density foam body provided between the ceramic piezoelectric plate and the upper cover may be mixed into other metallic or non-metallic materials to compose a sound save transmission medium. In this way, the sound quality or characteristic of the output unit man slightly change yet without affecting its basic characteristics.

Although the present invention has been illustrated and described with reference to the preferred embodiment thereof, it should be understood that it is in no way limited to the details of such embodiment but is capable of numerous modifications within the scope of the appended claims.

What is claimed is:

1. A ceramic piezoelectric type microphone, comprising a lower cover and an upper cover, and a receiving space confined by the lower and upper covers after they are connected, a signal wire being led in the receiving space via an extension portion of the lower cover and passing through a substrate to connect to an electrical circuit board, the other side of the circuit board being connected to a piezoelectric ceramic plate, a high-density foam body being sandwiched between the piezoelectric ceramic plate and a securing portion on an inner side of the upper cover, sound waves generated as a result of contact between cover surfaces and the user's throat skin passing through the foam body to the piezoelectric ceramic plate to be directly converted into a signal output, thereby eliminating most of the background noise except the sound of the user's voice.

2. A ceramic piezoelectric type microphone as claimed in claim 1, wherein when a ratio value of a diameter of the surface of the upper cover to a contact thickness formed by the upper cover is greater than 0.15, the transmission effect generated is most preferred.

3. A ceramic piezoelectric type microphone as claimed in claim 1, wherein the high-density foam body sandwiched bet eon the piezoelectric ceramic plate and the upper cover may be mixed into other metallic or non-metallic materials to compose a sound wave transmission medium.

* * * * *